United States Patent [19]

Salam

[11] Patent Number: 4,779,082

[45] Date of Patent: Oct. 18, 1988

[54] MATRIX DISPLAY APPARATUS EMPLOYING MOVABLE MAGNETIC ELEMENTS

[76] Inventor: Hassan P. A. Salam, 63 Lowther Road, Barnes, London, SW13, England

[21] Appl. No.: 25,562

[22] Filed: Mar. 13, 1987

[30] Foreign Application Priority Data

Mar. 13, 1986 [GB] United Kingdom ..... 8606193

[51] Int. Cl.[4] ..... G08B 5/26

[52] U.S. Cl. ..... 340/764; 340/783; 340/815.27; 40/449

[58] Field of Search ..... 340/783, 763, 764, 815.27; 40/449

[56] References Cited

U.S. PATENT DOCUMENTS

| | | | |
|---|---|---|---|
| 3,469,258 | 9/1969 | Winrow . | |
| 3,775,881 | 12/1973 | Salam | 340/336 |
| 4,069,480 | 1/1978 | Helwig | 340/373 |
| 4,139,841 | 2/1979 | Roberts | 340/815.27 |
| 4,163,332 | 8/1979 | Salam | 40/449 |
| 4,383,255 | 5/1983 | Grandjean et al. | 340/815.27 |
| 4,564,836 | 1/1986 | Vuilleumier | 340/783 |

*Primary Examiner*—Howard A. Birmiel

*Attorney, Agent, or Firm*—Laubscher & Laubscher

[57] ABSTRACT

The invention provides a display matrix system using display elements of the electromagnetic type. The system differs from others in that the currents applied to the display elements are unidirectional as there are no electrical switching components per element. This reduces the drive circuitry needed for the matrix. Selection of the display elements relies on current pulses of variable width.

In accordance with an aspect of the invention each one of a row or column of coils are connected together by N conductors, such that it is only necessary to drive 1/N of the coils in a row or column at a time:

In accordance with a further aspect of the invention means are provided which enable variation in the electrical pulse width applied to a display element in response to variation of one of ambient temperature and supply voltage.

18 Claims, 4 Drawing Sheets

MATRIX DISPLAY APPARATUS EMPLOYING MOVABLE MAGNETIC ELEMENTS

This invention relates to matrix displays, particularly of the dot matrix type in which each display clement of the matrix includes a rotatable member, such as a vane, carrying a permanent magnet actuated by a stationary electromagnet to provide contrasting appearances of the element. U.S. Pat. Nos. 4,069,480 and 4,163,332 describe some such rotatable members.

The present invention uses coincident current selection of the display elements in the matrix whereby actuation of selected display elements is by application of electrical currents to row and column conductors of the matrix, without recourse to individual electrical switching devices, such as diodes 14P, 14N in U.S. Pat. Nos. 4,069,480, for each display element. It is an object of the present invention to provide a display with coincident current selection in which the operating currents are reduced. It is another object of the present invention to provide a matrix display in which all the row and column currents are undirectional, instead of bidirectional, so as to reduce the drive circuitry.

An example of a matrix with coincident current selection is contained in U.S. Pat. No. 3,469,258. In this recited patent, the matrix relies for its operation on the use of reversibly magnetisable permanent magnet material, such as the alloy ALNICO, having a square loop characteristic as illustrated by curve 1 in FIG. 1 of this application. H is the applied magnetising force in oersted, and B is the resultant flux density in Tesla. To magnetise the material one way to provide a flux density of about 1 Tesla as indicated, requires a magnetising field of about +500 Oersted. To reverse the magnetisation requires a magnetising field of −500 oersted. The Alnico core acts as a switch with a threshold, because full magnetisation of 500 oersted will switch its magnetic state over whereas magnetisation of half of this intensity will leave the core unchanged. This principle is relied on for selection in U.S. Pat. No. 3,469,258.

The present invention does not rely for its operation on using a core of square loop characteristics. It uses instead a core of soft ferromagnetic material such as the nickel-iron alloys permalloy 49 and radiometal 4550, the characteristics of which are illustrated by curve 2 in FIG. 1. The magnetising force H needed to magnetisc the material to a flux density of 1 Tesla is about 1 oersted, instead of 500 Oersted. Because of this difference, the operating currents required for the present invention are much smaller than those for a matrix according to U.S. Pat. No. 3,469,258.

U.S. Pat. No. 3,775,881 describes another matrix display with coincident current selection. This uses open windings for producing the magnetising fields, and because they are open they are inefficient and so require large currents for operation. They have the further disadvantage that the rotatable elements are caged in by the windings, making them difficult to replace during maintenance.

Neither of U.S. Pat. Nos. 3,469,258 and 3,775,881 provides a display matrix system in which the row and column currents are all undirectional, whereas the present invention does. The use of undirectional currents instead of bidirectional ones simplifies the drive circuits for the rows and columns and so reduces their cost, as does the use of the lower currents.

European Patent application No. 0084959 describes yet another coincident current display system. Unlike the present invention, this uses two electromagnets per display element instead of one, and requires current reversal for the rows.

In all prior art coincident current systems, the drive circuits of either the rows or the columns must be capable of driving all the display elements of the matrix simultaneously. This results in a large amount of power being switched to the matrix. The present invention includes an arrangement for reducing this switched power, and also reducing the power handling requirements of either the column or row drive circuits, so as to reduce the cost of the display system.

BRIEF DESCRIPTION OF INVENTION

Figure 1:
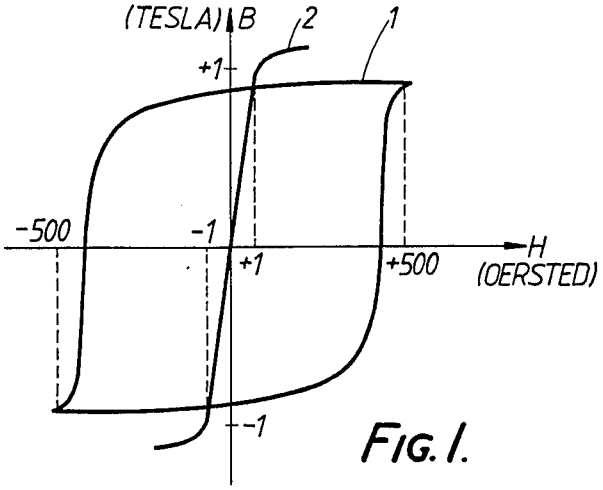
FIG. 1 shows the magnetisation characteristics of a soft ferromagnetic material compared with a hard ferromagnetic material.
Figure 2:
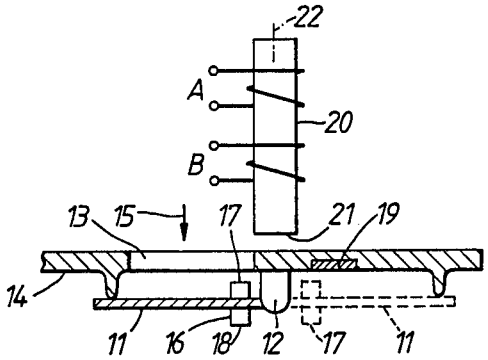
FIG. 2 is a sectional plan view illustrating a display element arrangement than can be used in the present invention.
Figure 3:
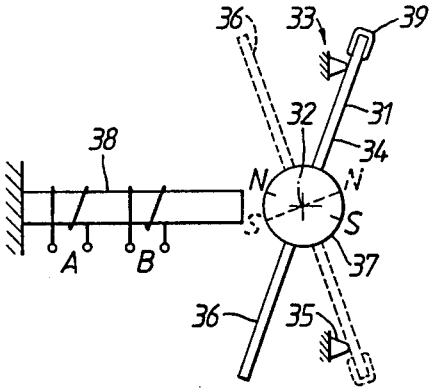
FIG. 3 is a side view of an alternative display element arrangement that can be used in the present invention.

FIGS. 2 and 3 illustrate two different display elements that can be used with the present invention In FIG. 2 a vane 11, of the type described in U.S. Pat. No. 4,163,332, is mounted for rotation about a vertical hinge axis 12 between a first (dark) position shown solid in which it covers an aperture 13 in a base plate 14 which is back illuminated by light rays 15 from a common light source not shown, and a second (bright) position, shown dotted, in which aperture 13 is uncovered. Vane 11 carries a permanent magnet 16 having north and south pole faces 17 and 18 respectively. Embedded in base plate 14 to the right of hinge axis 12 is a portion 19 of soft iron or Permalloy. An elongate pole member 20 of Permalloy or other ferromagnetic material of low remanence and high permeability is attached to base plate 14 by means not shown. It has windings A and B respectively. These can be side-by-side or wound one over the other. The display element can be switched to the bright state, shown dotted, by energising either of coils A, B so that pole face 21 is magnetised north. It can be switched to the dark state by energising either of the coils so that pole face 21 is magnetised south. In the absence of ferromagnetic member 19 the operation is symmetrical in that the electrical energy that must be applied to coil A or B is the same for both directions of vane switching. Because of ferromagnetic member 19, however, the operation is asymmetrical, and more energy is needed to switch vane 11 from the bright to the dark state than from the dark to the bright state, since ferromagnetic member 19 attracts magnet 16 strongly when the display element is in the bright state. The asymmetry can be achieved by dispensing ferromagnetic member 19 and arranging that hinge axis 12 is inclined to the vertical, by 45 degrees for example, so that vane 11 is higher when it is in the dark state than when it is in the bright state.

Figure 3A:
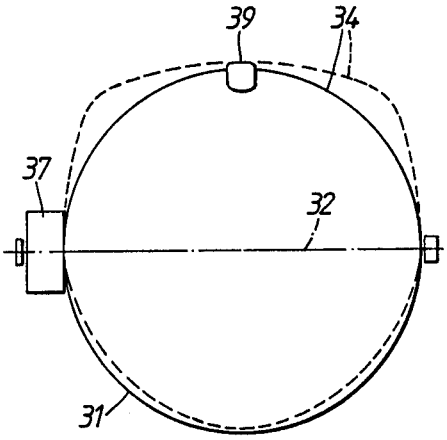
FIG. 3*a* is a front elevational view of the display element in FIG. 3.

In the arrangement in FIGS. 3, 3*a*, a circular vane 31 of the type used in the aforementioned U.S. Pat. No. 3,469,258 is mounted for rotation about a central horizontal axis 32 to rotate between a first (dark) position where it is against a stop 33 and displays to the observer a dark face 34 and a second (bright) position shown dotted where it is against a stop 35 and displays a brightly painted face 36. Attached to a side edge of vane 31 is a cylindrical permanent magnet 37 having north and south poles N and S respectively. A fixed pole member 38 of Permalloy or other soft ferromagnetic material having windings A and B can be magnetised by energising winding A or B so that its tip facing magnet 37 is a north pole, thus causing vane 31 to be set to the bright state, indicated in dotted form in FIG. 3. If the pole tip is magnetised south, vane 11 will be set to its dark state. A small weight 39 is attached to vane 31 to render its operation asymmetrical so that more torque and energy is needed to set it to the dark state than to set it to the bright state. Member 39 can be dispensed with if vane 31 is altered in shape as indicated by the dotted outline in FIG. 3*a* so that its centre of gravity is offset from hinge axis 32.

With each of the arrangements in Figures 2 and 3 the energy needed to switch the vane over can be applied to coil A or B as a voltage or current pulse of adequate amplitude and having a duration that is preferably less than the flight time of the vane between its two stable positions. The electrical pulse energy is converted to kinetic energy in the vane which keeps the vane travelling on to the other position after the pulse is terminated. The pulse duration, TDB, just necessary to switch the vane from the dark to the bright position is, because of the asymmetry, less than the pulse width TBD, just necessary to switch the vane from the bright to the dark position. It is desirable to arrange the asymmetry so that TDB is less than a third of TBD. It should be pointed out that if a pulse of width TDB, instead of TBD, is applied to a coil to urge a vane that is in the bright state towards the dark state, the vane cannot switch over, as insufficient energy is applied. It may flutter a few degrees. The flutter is brief and not so noticeable, particularly if the degree of asymmetry is high.

Figure 4:
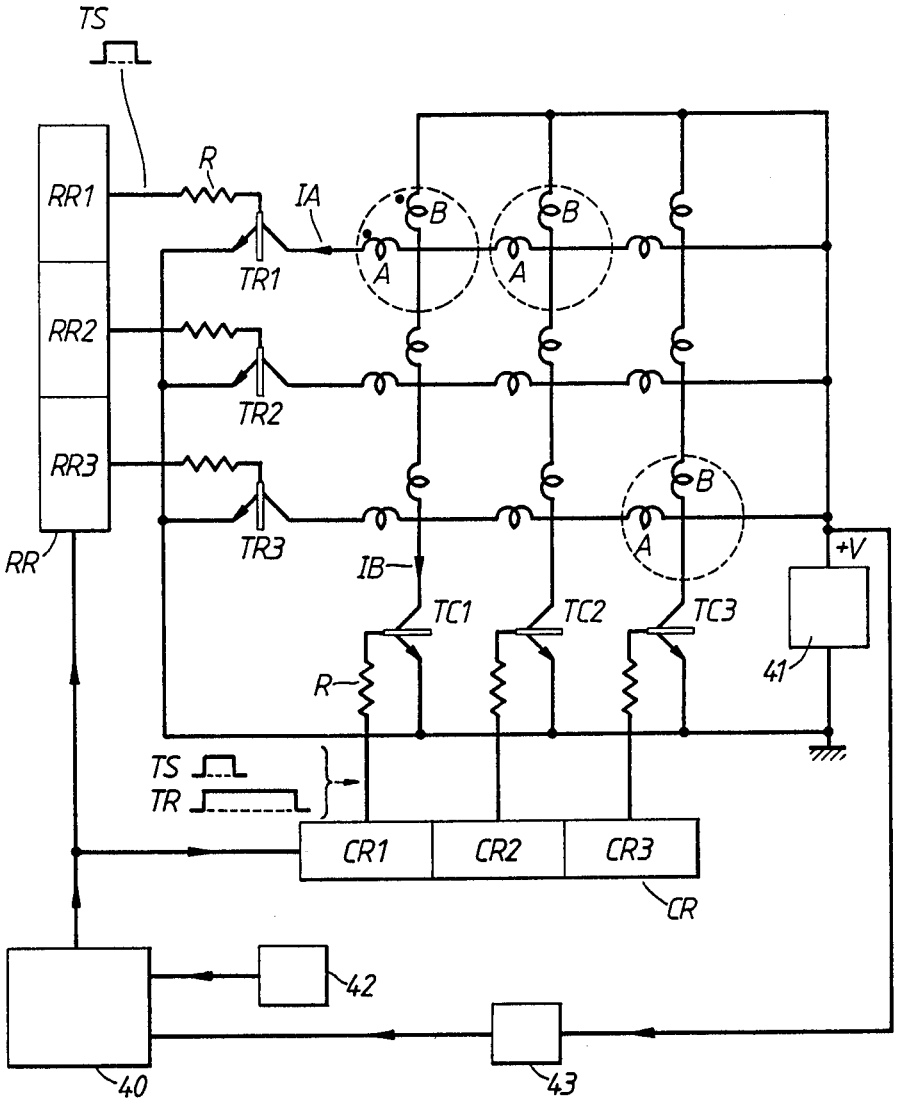
FIG. 4 is a diagram illustrating a system for driving the coils of the display elements according to the invention.

FIG. 4 illustrates a display apparatus according to the invention having a matrix of three row and three columns of display elements such as that in FIG. 2 or FIG. 3. This matrix is small to simplify the illustration. In practice there would be more rows and columns. Of the display elements only coils A and B are represented. Associated with each row of the matrix is one bit of a 3-bit register RR the output of which controls a grounded-emitter NPN transistor switch TR, which in turn controls current flow through coils A of the row. The coils are shown connected in series but they could alternatively be connected in parallel. Similarly, each column of the matrix is controlled by one bit of a 3-bit register CR which controls a grounded emitter NPN transistor switch TC, which in turn controls current flow through coils B of the column, which are shown connected in series. All coils are powered from the positive terminal of a common D.C. supply source 41, the other terminal of which is grounded. There is a resistor R in series with the base terminal of each transistor, to limit base current. The winding senses of coils A and B are such that current flow IA through coil A urges the vane towards the bright position and current flow IB through coil B urges the vane towards the dark position. Windings A and B are preferably arranged so that when they pass current simultaneously their magnetic fields substantially cancel each other.

Registers RR and CR are controlled by control means 40, which may be a computer. Writing on the matrix is achieved as follows. The matrix is first blanked, i.e all vanes are set to the dark state, by setting each output of register CR to the high state, so turning on transistors TC. Each transistor TC is kept on for a period TR that is appreciably greater, for example more than 25% greater, then the period TBD just needed for switching a vane from bright to dark. Transistors TC can be turned on simultaneously or in sequence. After blanking, information is written, i.e. displayed, onto the matrix row by row. Each row transistor TR in turn is switched on by appropriate setting of its associated register bit for a period TS which is appreciably greater than the period TDB just sufficient for switching from dark to bright. TS is also chosen to be appreciably less than TBD. At about the same time that the row is selected and for a duration approximately equal to TS, selected ones of transistors TC are switched on, by means of register CR, corresponding to the column positions within the selected row where the vanes are to be left in their dark state after setting the row. The effect of the column current on a display element in a selected row is to cancel the effect of the row current and thus to suppress switching to the bright state. The effect of the column current on each display element in the column, other than the one at the selected row, is to leave it unchanged, though there may be a brief small flutter of the vane.

Figure 5:
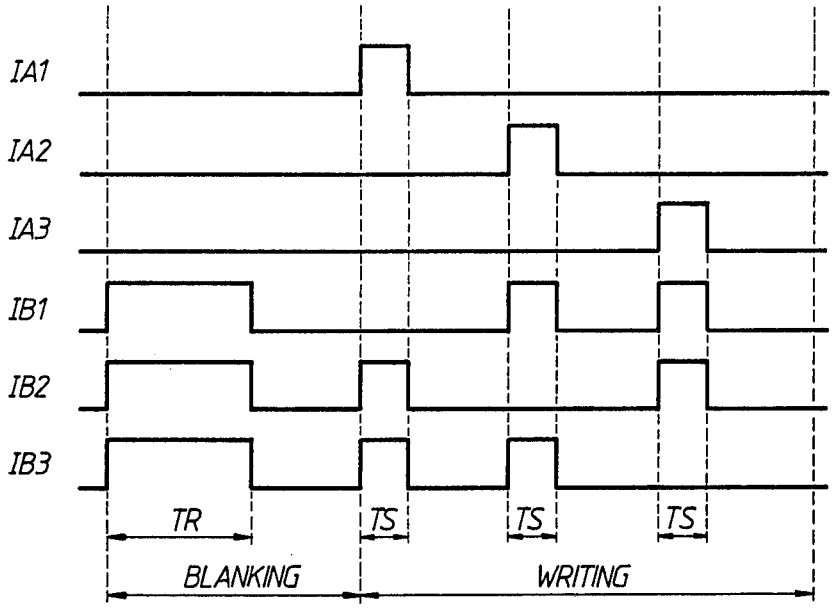
FIG. 5 is a diagram illustrating a sequence of current pulses generated in the arrangement depicted in FIG. 4.
Figure 5A:
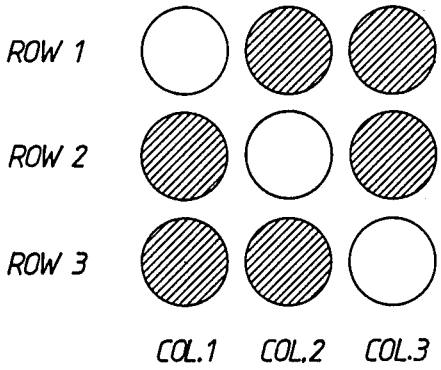
FIG. 5*a* illustrates the display pattern resulting from the sequence in FIG. 5.

FIG. 5 illustrates, by way of example, the currents for the three rows and three columns respectively that are used to portray the image shown in FIG. 5*a*.

Drive pulse widths TS and TR are preferably, though not essentially, arranged to increase with increase of ambient temperature, so as to compensate for the drop in pulse power that otherwise occurs due to the coil resistances rising with temperature.

Controller 40 determines the pulse widths by controlling the settings of the registers and it can be arranged to alter pulse widths depending on data received from a temperature sensor 42 having digital outputs representing the temperatures fed to controller 40 as indicated. The pulse widths can also be increased to compensate for loss of pulse power due to any drop in power supply voltage V, by offering the digital value of the voltage V, derived from a suitable analog to digital converter 43, into control computer 40 and arranging the computer software to increase the pulse width as the value of V drops.

The switching transistor in a column or row, TC or TR; is switched on, for example by the respective register bit being loaded into a high state (digital "1") under control of the controller 40. Switch off of the column or row occurs when the respective register bit is set into a low (digital "0") state under control of the controller 40 after the desired time period determining the pulse width has elapsed.

Loading of registers RR and CR is arranged to take negligible time compared with the periods for which the coils are energised.

An alternative to providing the temperature and voltage compensation discussed above is to use constant current drive circuits for the matrix, but these tend to be more costly.

Figure 6:
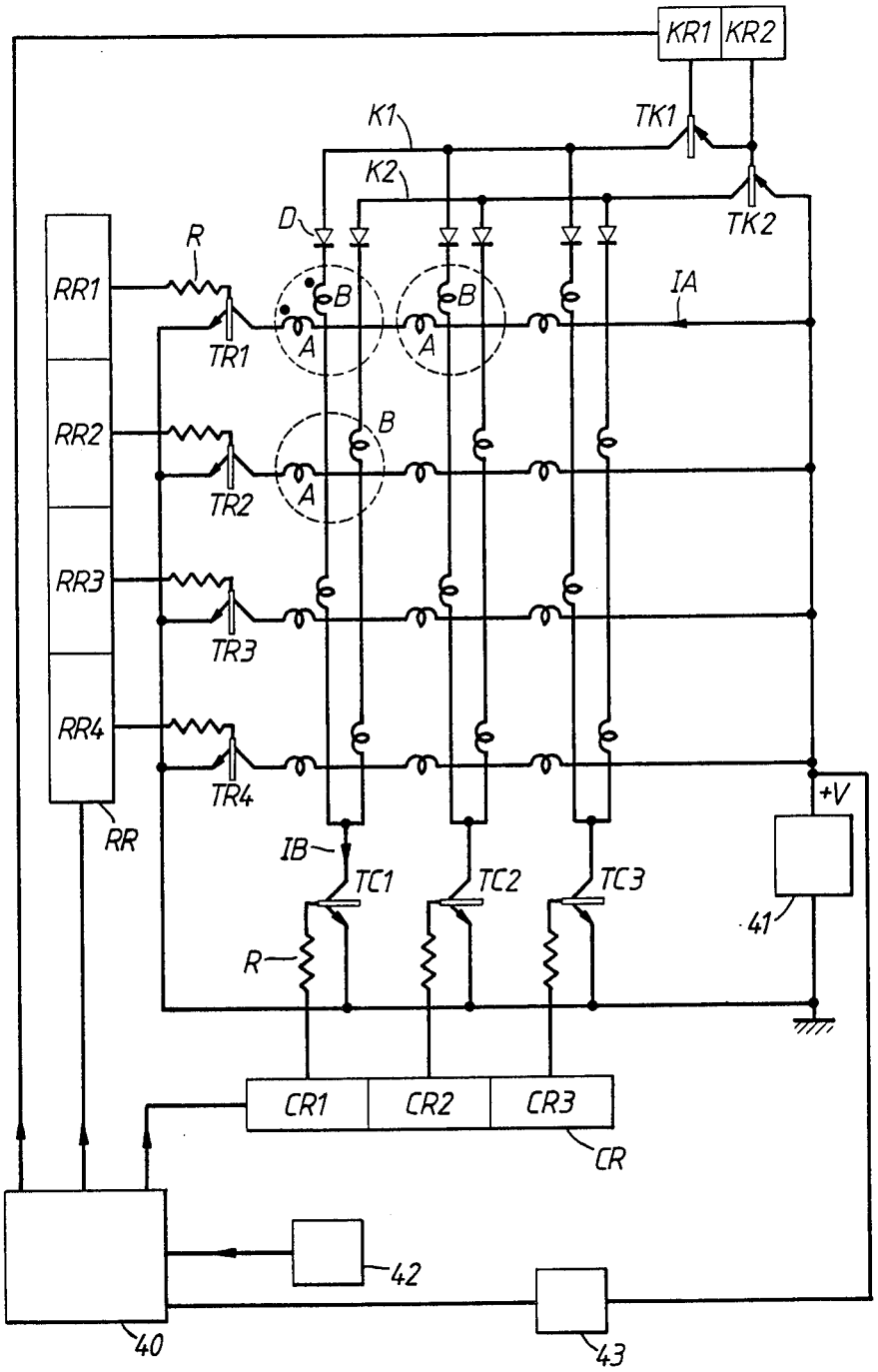
FIG. 6 is a diagram illustrating an embodiment of a further system in accordance with a further aspect of the invention for driving a coincident current display matrix.

For large matrixes, for example having 100 rows, the power that has to be delivered from D.C. supply source 41 via column switching transistors TC can be considerable. in the worst case, when a selected row is to be left blank during writing, all coils B in the matrix have to be driven simultaneously. FIG. 6 illustrates a drive system arranged to alleviate this problem.

FIG. 6 is similar in construction and operation to FIG. 4, except for the wiring of coils B and their selection. Rows and columns of the matrix are selected as was described with reference to FIG. 4, by setting the associated bits in register RR and CR. In the illustrated examples an "N-Phase" drive system is used to drive the coils B.

In the illustrated example N=2.

For each phase of the N-phase column drive there is a corresponding drive bus K which is selectively energised under control of controller 40 by means of a register KR, which when loaded with the correct bit, causes the bus K to be connected to the positive terminal of D.C source 41 by means of switching transistor TK. For each column of coils B there are N conductors (in this case 2) each connecting together 1/N the number of coils B in the column and each connected to a corresponding one of buses K by means of a diode D.

In the illustrated example it is therefore possible to select half only of the coils B in a column to be driven at any time, instead of all the coils in the column as is the case in prior art coincident current display systems. This leads to a saving of power.

When an odd numbered row is driven transistor TKI alone is turned on, and when an even numbered row is driven transistor TK2 alone is driven.

In operation, consider the example wherein the second row (associated with register bit RR2 and transistor TR2) has been selected for setting of the display elements associated therewith. Consider that it is desired to leave all the display elements in that row blank.

In order to do this it is necessary to drive all the column coils B associated with that row. To do this register bit KR2 is loaded with an enabling bit in order to enable conductor K2 via transistor TK2 which enables ½ of the coils B in each column. The enabled coils B are driven by appropriate loading of the column register CR.

In this case therefore, even though all three columns illustrated had to be driven in order to leave the display elements in row 2 blank after writing only half the coils B in the display matrix needed to be supplied with power (the coils B associated with row 2 and row 4). In the prior art coincident current display systems it would have been necessary to supply with power all the coils B in the matrix to achieve an analogous display setting in the row ie all elements in the same display state.

N may be increased, if necessary, for example for very large matrices. As N is increased the power handling requirement of column switches TC is reduced.

N-phase drive along the lines described in this specification can be used for coincident current displays using display elements differing from those described in relation to FIGS. 1 to 5 above.

It will be realised that the above specification may indicate to those skilled in the art other forms in which the principles of this invention may be used, without departing from this invention. It is, therefore intended that the invention be limited only by the scope of the appended claims.

What is claimed is:

1. In a display system comprising,

A. a matrix of display elements arranged in rows and columns, each display element comprising;

a member movable between first and second positions of contrasting appearance;

a ferromagnetic element coupled to said member;

stationary ferromagnetic flux guiding means for guiding flux towards said ferromagnetic element to cause movement of said member and, first and second flux generating means associated with said flux guiding means;

B. a row drive circuit associated with each of the rows of display elements for providing drive current to the row, said first flux generating means of the display elements of the row being connected together for simultaneous energisation of them by the row drive circuit;

C. a column drive circuit associated with each of the columns of display elements for providing drive current to the column, said second flux generating means of the display elements of the column being connected together for simultaneous energisation of them by the column drive circuit;

D. control means for controlling the currents applied by the row and column drive circuits wherein the improvement comprises (a) said stationary flux guiding means comprises a part of low remanence ferromagnetic material;

(b) said display element is arranged so that the magnitude of the flux necessary to be applied by said flux guiding means to move the member from the first to to the second position is less than that of the flux necessary to be applied to move the member from the second to the first position;

(c) one of said row and column drive circuits being arranged, under control of said control means, to apply an electrical pulse of energy sufficient to cause the flux generating means connected thereto to cause movement of the respective members of the display elements from the first to the second position, and (d) the other one of said row and column drive circuits being arranged, under control of said control means, to apply first and second electrical pulses to the flux generating means connected thereto, said first electrical pulse being of insufficient energy to move the respective members from the second to the first position and being of sufficient energy to cause the flux generating means to generate flux sufficient to substantially cancel the effect of flux generated in respect of the same display element by flux generating means connected to the said one of the row and column drive circuits so that movement of the member from the first to the second position does not occur, and said second electrical pulse being of sufficient energy to cause the flux generating means to cause movement of the respective members of the display elements from the second position to the first position.

2. A display system in accordance with claim 1, wherein said flux generating means are coil windings and said flux guiding means is a core member on which the coils are wound.

3. A display system in accordance with claim 2, wherein for each of said windings the direction of current flow in the winding is arranged to be always the same.

4. A display system in accordance with claim 1, wherein said row and column drive circuits comprise switching means connected to respective row and column conductors, for selectively switching current to the respective row and column in response to the control means.

5. A display system in accordance with claim 4 wherein the control means comprises shift registers connected to the row and column drive circuits, the shift registers being arranged to be loaded with enabling bits to enable the switching means of the respective rows and column to cause electric current to be driven thereto, and being arranged to be loaded with disabling bits to disable the switching means of the respective rows and columns to prevent electric current being driven thereto.

6. A display system in accordance with claim 2, wherein said first and second pulses are of the same amplitude but different duration.

7. A display system in accordance with claim 6 wherein the duration of at least one of said pulses is arranged to increase with increasing ambient temperature so as to at least partly compensate for the increase in resistance of said coils due to increase in the temperature.

8. A display system as claimed in claim 6, wherein there is provided a d.c. power source and wherein the duration of at least one of said pulses is arranged to decrease as the voltage of said d.c. power source increases.

9. A display system in accordance with claim 1, wherein said flux generating means of at least one of said rows and columns are connected to the respective drive circuitry by means of N separate conductors (where N is an integer), each of the N conductors connecting together a number of the flux generating means of the at least one of the rows and columns, and there are provided switching means connected to said conductors and under control of the control means, for selecting which of the N conductors in the at least one of the rows and columns drive current is to be applied to at any time.

10. In a display system comprising,

A. a matrix of display elements arranged in rows and columns, each display element comprising;

a member movable between first and second positions of contrasting appearance, a ferromagnetic element coupled to said member, stationary ferromagnetic flux guiding means for guiding flux towards said ferromagnetic element to cause movement of said member, and first and second flux generating means associated with said flux guiding means;

B. a row drive circuit associated with each of the rows of display elements for providing drive current to the row, said first flux generating means of the display elements of the row being connected together for simultaneous energisation of them by the row drive circuit;

C. a column drive circuit associated with each of the columns of display elements for providing drive current to the column said second flux generating means of the display elements of the column being connected together for simultaneous energisation of them by the column drive circuit, and D. control means for controlling the currents applied by the row and column drive circuits wherein the improvement comprises (a) said display element being arranged so that the magnitude of the flux necessary to be applied by said flux guiding means to move the member from the first to the second position is less than that of the flux necessary to be applied to move the member from the second to the first position.

(b) one of said row and column drive circuits being arranged under control of said control means, to apply an electrical pulse of energy sufficient to cause the flux generating means connected thereto to cause movement of the respective members of the display elements from the first to the second position, and (c) the other one of said row and column drive circuits being arranged, under control of said control means, to apply a pulse to the flux generating means connected thereto, said electrical pulse being of insufficient energy to move the respective members from the second to the first position and being of sufficient energy to cause the flux generating means to generate flux sufficient to substantially cancel the effect of flux generated in respect of the same display element by flux generating means connected to the said one of the row and column drive circuits so that movement of the member from the first to the second position does not occur.

11. A display system in accordance with claim 10, wherein said flux guiding means is a member of low remanence ferromagnetic material.

12. In a display system comprising;

A. a matrix of display elements arranged in rows and columns, each display element comprising;

a member movable between first and second positions of contrasting appearance, a ferromagnetic element coupled to said member, a flux guiding means for guiding flux towards said ferromagnetic element to cause movement of said member, a first flux generating means associated with said flux guiding means, and a second flux generating means associated with said flux guiding means;

B. a row drive circuit associated with each of the rows of display elements for providing electrical drive to the row, said first flux generating means of the display elements of the row being driven by said row drive circuit;

C. a column drive circuit associated with each of the columns of display elements for providing electrical drive to the column, said second flux generating means of the display elements of the column being driven by said column drive circuit, and D. control means for controlling the currents applied by the row and column drive circuits wherein the improvement comprises said flux generating means of the display elements of at least one of said rows and columns are connected to the respective drive circuitry by means of N separate conductors (where N is an integer), each of the N conductors connecting together a number of the flux generating means of the at least one of the rows and columns, and there are provided switching means connected to said conductors and under control of the control means, for selecting which of the N conductors in the at least one of the rows and columns drive current is to be applied to at any time.

13. A display apparatus in accordance with claim 12, wherein the flux generating means in each column of the matrix are connected to the respective column drive circuitry by N separate conductors.

14. A display apparatus in accordance with claim 12 wherein the flux generating means in each row of the matrix are connected to the respective row drive circuitry by N separate conductors.

15. A display apparatus including a matrix of display elements arranged in vertical and horizontal rows, each said display element including a rotatable member, a permanent magnet coupled to said rotatable member, a member of ferromagnetic material and a coil wound thereon, said display apparatus further including a d.c power source and means for applying power from said d.c source to a plurality of said coils in the form of a voltage pulse, said pulse being arranged to have a duration dependent on at least one of the ambient temperature of the display apparatus and the voltage of said d.c power source.

16. A display apparatus as claimed in claim 15, wherein the duration of said pulse is arranged to increase with increasing ambient temperature so as to at least partly compensate for the increase in the resistance of said coils due to increase in the temperature.

17. A display apparatus as claimed in claim 15, wherein the duration of said pulse is arranged to decrease as the voltage of said d.c power source increases.

18. A display apparatus as claimed in claim 15, wherein the pulse duration is determined by data processing means arranged to receive a digital input from an analogue to digital convertor which is arranged to monitor one of said ambient temperature and voltage of said d.c power source.

* * * * *

UNITED STATES PATENT AND TRADEMARK OFFICE

CERTIFICATE OF CORRECTION

PATENT NO. : 4,779,082

DATED : October 18, 1988

INVENTOR(S) : Hassan P.A. Salam

It is certified that error appears in the above-identified patent and that said Letters Patent is hereby corrected as shown below:

On the title page Insert

--(73)Assignee: Unisplay S.A. Geneva Switzerland --.

Signed and Sealed this

Twenty-eighth Day of March, 1989

*Attest:*

DONALD J. QUIGG

*Attesting Officer*

*Commissioner of Patents and Trademarks*